United States Patent [19]

Kikuchi

[11] 4,060,182

[45] Nov. 29, 1977

[54] BOTTLE WITH ELECTRICALLY-OPERATED PUMP

[76] Inventor: Yoshito Kikuchi, 7-37, Otani, Nishinomiya, Hyogo, Japan

[21] Appl. No.: 665,435

[22] Filed: Mar. 10, 1976

[30] Foreign Application Priority Data

| | | |
|---|---|---|
| Mar. 10, 1975 | Japan | 50-32783 |
| Mar. 12, 1975 | Japan | 50-34058 |
| Mar. 12, 1975 | Japan | 50-34059 |
| Mar. 14, 1975 | Japan | 50-34850 |

[51] Int. Cl.[2] ..... B67D 5/48; F04B 49/02

[52] U.S. Cl. ..... 222/333; 222/385; 417/424

[58] Field of Search ..... 222/239, 333, 383, 385; 415/201, 126; 417/424

[56] References Cited

U.S. PATENT DOCUMENTS

| | | | |
|---|---|---|---|
| 2,957,425 | 10/1960 | Nagle | 415/126 |
| 3,088,416 | 5/1963 | Davis | 415/201 X |
| 3,289,897 | 12/1966 | Ginsberg | 222/385 X |
| 3,523,629 | 8/1970 | Chi | 222/385 X |
| 3,750,910 | 8/1973 | Se-Kit | 222/389 |
| 3,905,520 | 9/1975 | Nishioko | 222/383 X |

*Primary Examiner*—Robert B. Reeves
*Assistant Examiner*—David A. Scherbel
*Attorney, Agent, or Firm*—Wenderoth, Lind & Ponack

[57] ABSTRACT

A bottle with an electrically-operated pump. The boxed cover containing dry cells, a motor and a switch, and the fistulous plug for stopping a mouth of a vacuum bottle are composed separately. The boxed cover hinges the upper and rear part of the vessel. The fistulous plug connects an inner pipe extending downward to an outer pipe extending laterally. A propeller shaft having a propeller at the lower end passes through the fistulous plug and the inner pipe. The rotation of the motor is transmitted to the propeller shaft by a clutch assembly.

9 Claims, 8 Drawing Figures

BOTTLE WITH ELECTRICALLY-OPERATED PUMP

BACKGROUND OF THE INVENTION

This invention relates to a bottle with an electrically-operated pump and more particularly, it relates to an improvement of a vacuum bottle designed to pump the liquid contents by turning a propeller in the bottle by means of dry cells and a miniature motor incorporated into a boxed cover of the bottle.

SUMMARY OF THE INVENTION

The characteristic features of this invention reside in the fact that a boxed cover containing dry cells, a motor and a switch hinges the upper and rear part of the vessel, and that a fistulous plug, comprising a propeller shaft driven by the motor and pipes passing the liquid contents therethrough, is constructed separately from the boxed cover, and that the rotation of the motor is smoothly transmitted to the propeller shaft by the engagement of clutch pieces when the boxed cover is closed. One of the clutch pieces is attached at the lower end of the motor shaft, and another is attached at the upper end of the propeller shaft.

An object of this invention is to provide a bottle with an electrically-operated pump, in which the fistulous plug can be easily removed when the vacuum bottle is filled with liquid.

Another object of this invention is to provide a bottle with an electrically-operated pump in which the liquid contents thereof can be pumped therefrom smoothly, and with little vibration or noise.

A further object of this invention is to provide a bottle with an electrically-operated pump in which the rather heavy boxed cover can be opened and closed in safety, and wherein the structure enables those electrical parts to be rust-proof which most affect the life of this kind of bottle, and wherein there is no leakage when the bottle falls down and there is no accumulation of water that leaks into parts other than the pipes.

Other objects and advantages of the invention will be apparent from the following description.

BRIEF DESCRIPTION OF THE DRAWINGS

Reference will now be made to the accompanying drawings in which.

DETAILED DESCRIPTION OF THE INVENTION

In the figures, 1 is a vacuum bottle formed from a double glass bottle. The bottle is held within a casing 2 by known means. The brim 1*a* of the vacuum bottle is held by fixing a funnel-like pour member 3 to the upper part of the casing 2, and the pour member has a bottom opening 3' with a beak portion 3*a* at the front end. This bottom opening 3' is equal to or larger than the mouth 1' of the vacuum bottle.

Figure 1:
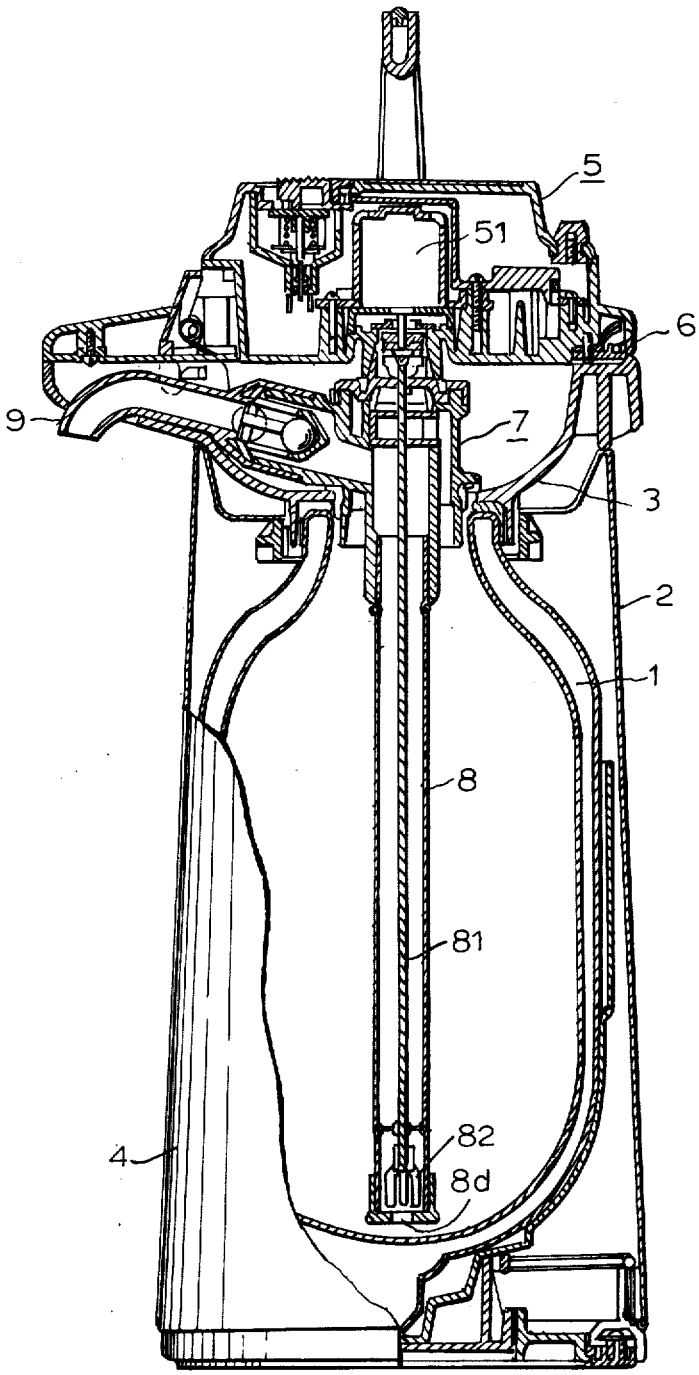
FIG. 1 is a longitudinal sectional view of a preferred embodiment of this invention.
Figure 2:
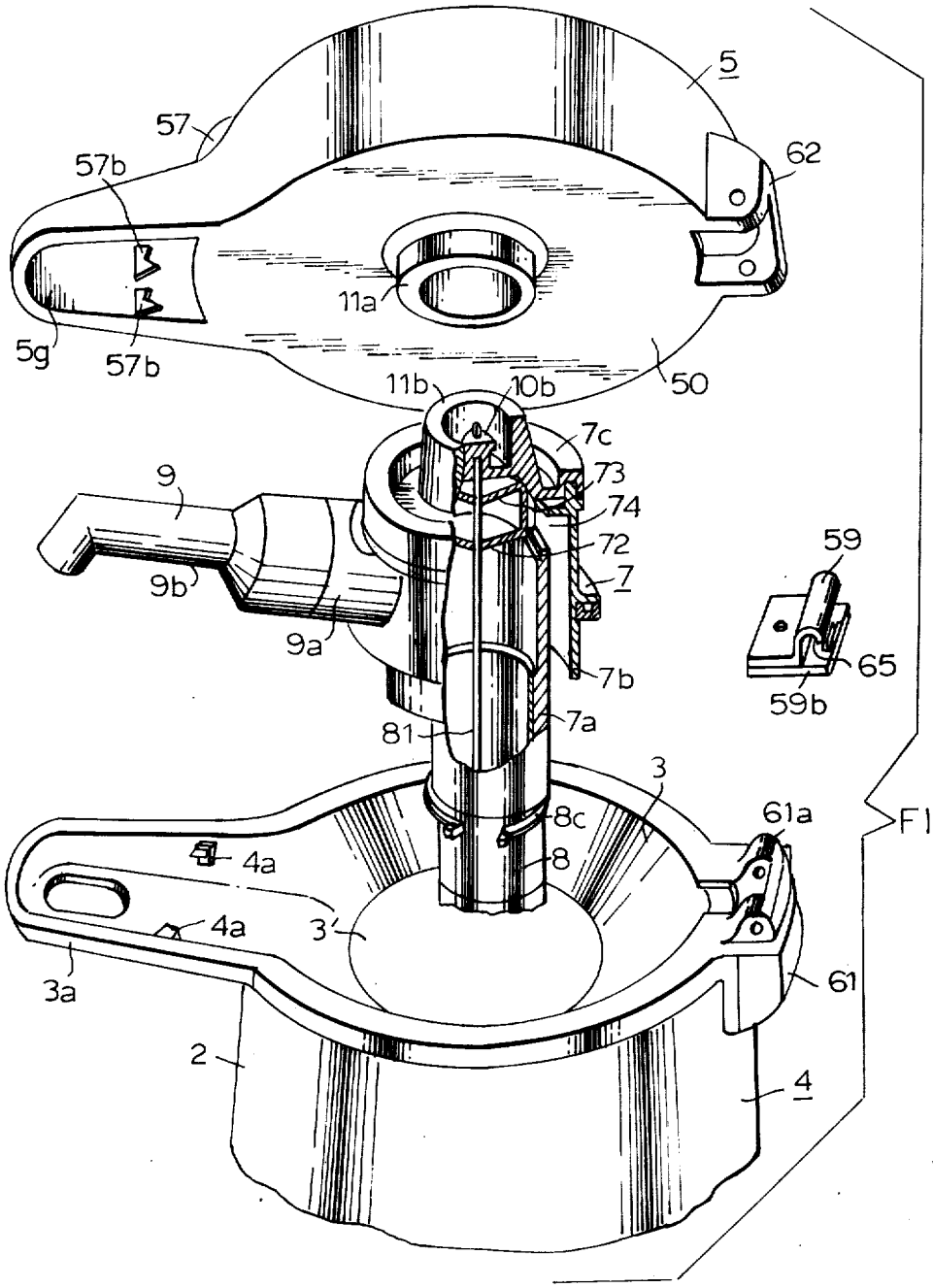
FIG. 2 is a perspective view, broken in part, of the disassembled embodiment of FIG. 1.
Figure 7:
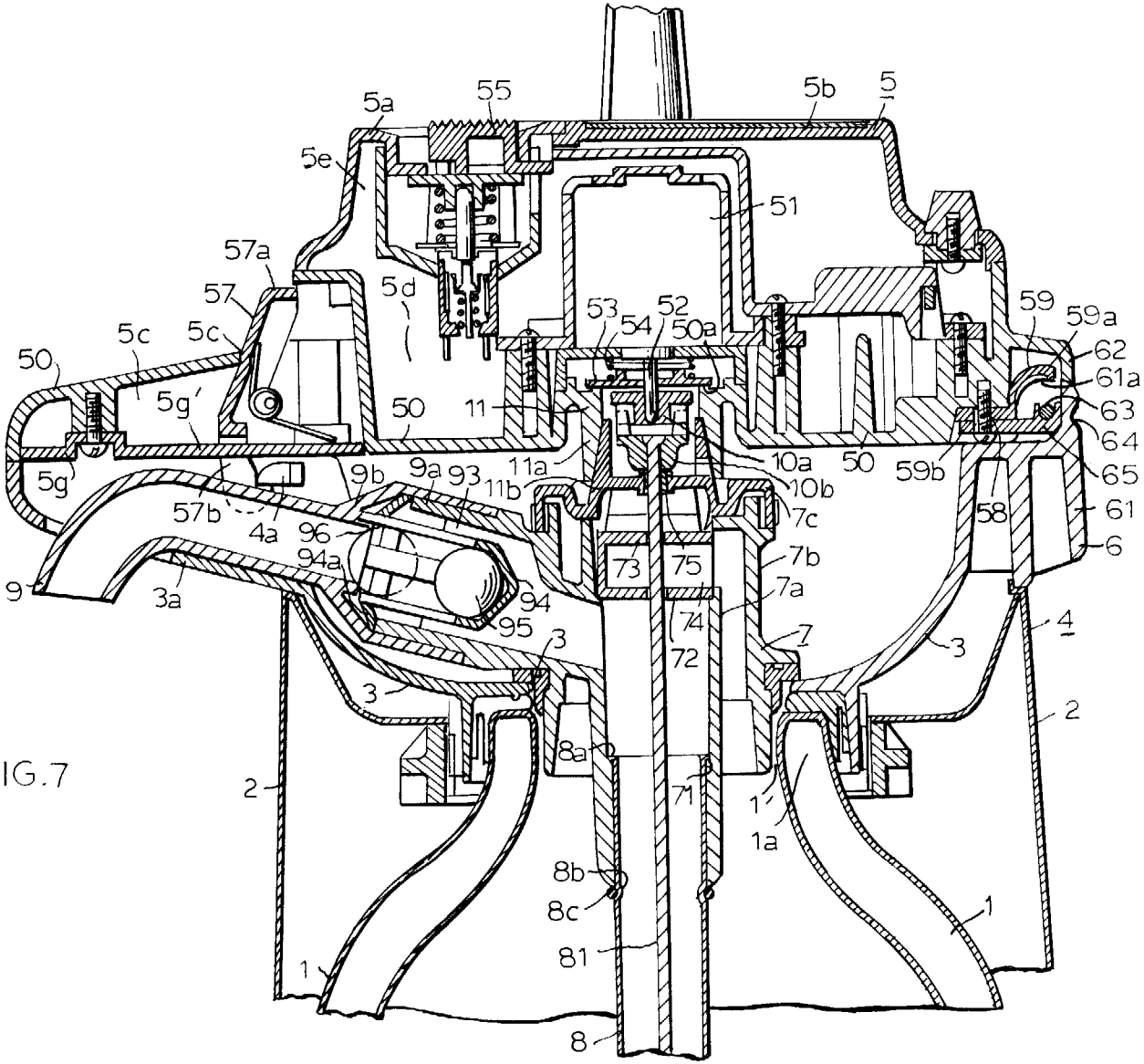
FIG. 7 is an enlarged longitudinal sectional view of the principal part in FIG. 1.

As shown in FIGS. 2 and 7, the bottle of this invention is made of a vessel 4 comprising the casing 2 holding the vacuum bottle 1 therein with a pour member 3 attached to its upper part, and a boxed cover 5 thereover. The pour member and cover are connected by a lower hinge piece 61, an upper hinge piece 62 attached at the back sides of each, and a hinge rod 63.

A fistulous plug 7 is downwardly inserted through the mouth 1' of the vacuum bottle from a bottom opening 3' of the pour member 3.

An inner pipe 8 extending downward and an outer pipe 9 extending laterally are connected to the fistulous plug 7; the pipes are connected to the plug so that they can be treated as one when the fistulous plug 7 is inserted and removed. The fistulous plug 7 is a double cylindrical plug comprising an inside cylinder 7*a* and an outside cylinder 7*b* sealed with a common upper cover 7*c*.

The inner pipe 8 has an outside flange 8*a* around the upper end and a groove 8*b* formed by constricting partially, the inside and outside diameter of the pipe at the part thereof that is 1/20 ~ 1/5 of the pipe length down from the upper end. The inside diameter of the inside cylinder 7*a* of the fistulous plug 7 becomes, at the lower part, smaller and is about the same as the outer diameter of the inner pipe 8. A step 71 is formed at the inner surface of the inside cylinder when the diameter is reduced. Since the outside flange 8*a* of the inner pipe 8 is designed to be caught by the upper surface of the step 71, and since the dimension of the lower part of the inside cylinder 7*a* is designed so that the groove 8*b* is situated beneath the lower end of the inside cylinder 7*a*, the inner pipe 8 can be easily and security connected to the fistulous plug 7 when a snap ring 8*c* or the like is fastened around the groove 8*b*.

Figure 6:
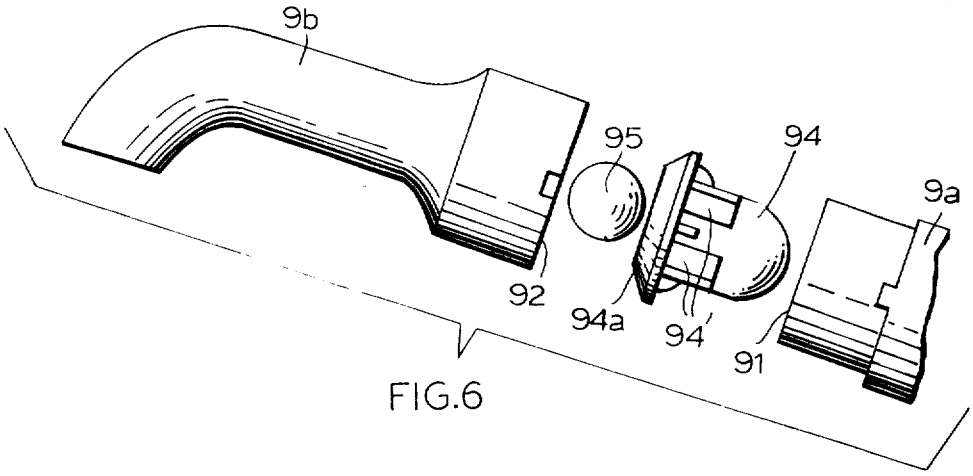
FIG. 6 is a front elevation view of water leak preventive valve disassembled in parts.

At the inside end of a pouring pipe 9*a* integrated with the fistulous plug 7 and connected to the inner pipe 8, a lower valve casing 91 is formed, and at the inside of the jointing end of a round pipe 9*b*, an upper valve casing 92 is formed, the round pipe 9*b* attached removably to the pouring pipe 9*a* and being bent downward. Therefore, the lower valve case 91 and the upper valve case 92 are combined to form a valve chamber 93 when the round pipe 9*b* is coupled with the pouring pipe 9*a* to form the outer pipe 9, as shown in FIG. 6.

A valve holder 94 is set into the valve chamber 93, and a ball valve 95 is put into the valve holder 94. In this embodiment, the valve holder has an outside flange 94*a* at the front end, and the outside flange 94*a* is between the front edge of the pouring pipe 9*a* and the pressing cylinder 96 formed inside of the upper valve case 92 to fix the valve holder 94. A hole 94' for water passage is perforated on the surface of the valve holder 94. In this embodiment, the inside diameter of the pressing cylinder 96 is designed smaller than the diameter of the ball valve 95 so that the pressing cylinder 96 works as a valve stopper for the ball valve 95.

A propeller shaft 81 is inserted longitudinally through the inside cylinder 7*a* of the plug 7 and the inner pipe 8. The lower end of the propeller shaft 81 is situated near the lower opening 8*d* of the inner pipe 8 and a propeller 82 is attached thereon. The upper end of the propeller shaft 81 projects from the upper part of the fistulous plug 7 and has a lower clutch piece 10b which engages an upper clutch piece 10a, of a motor 81. The propeller shaft 81 is not only borne by the lower part of the inner pipe 8 and the upper part of the fistulous plug 7, but also by partitions 72, 73 fixed above the pouring pipe 9a.

Partitions 72, 73 are provided in order to prevent the liquid W which is pumped up by the propeller 82 from entering into the upper end of the fistulous plug 7 and into the space where the lower clutch piece 10b is fixed through a shaft hole. In spite of the existence of the lower partition 72, a little quantity of liquid will pass through the shaft hole. The liquid which has passed the partition, however, does not accumulate in the upper part of the fistulous plug 7, but flows out from a window 74 and returns to the vacuum bottle 1 through the inside space of the outside cylinder 7b, because the window 74 is perforated on the side wall of the inside cylinder 7a and is positioned at the same level as the lower partition 72. The window 74 faces the inside space of the outside cylinder 7b. Less liquid goes up through the shaft hole of the upper partition 73, but that which does returns to the vacuum bottle 1 as described above.

The bottom member 50 of the boxed cover 5 is formed so that only the part which covers the upper side of the beak portion 3a is placed at a higher level than the rest part of the bottom member 50. Therefore, a downward looking space 5c is formed at the front part of the boxed cover 5 and an upward looking space 5d is formed at its rear part. The greater part of the space 5d is covered with a fixed cover 5a, which corresponds to the upper part of the boxed cover 5, to form an isolated chamber 5e, wherein electrical parts like the motor 51 and lead wires are contained. The motor shaft 52 projects downward through the opening of a circular pedestal 50a provided around the center of the bottom member 50, and the upper clutch piece 10a is attached to the lower end of the motor shaft 52.

Figure 3:
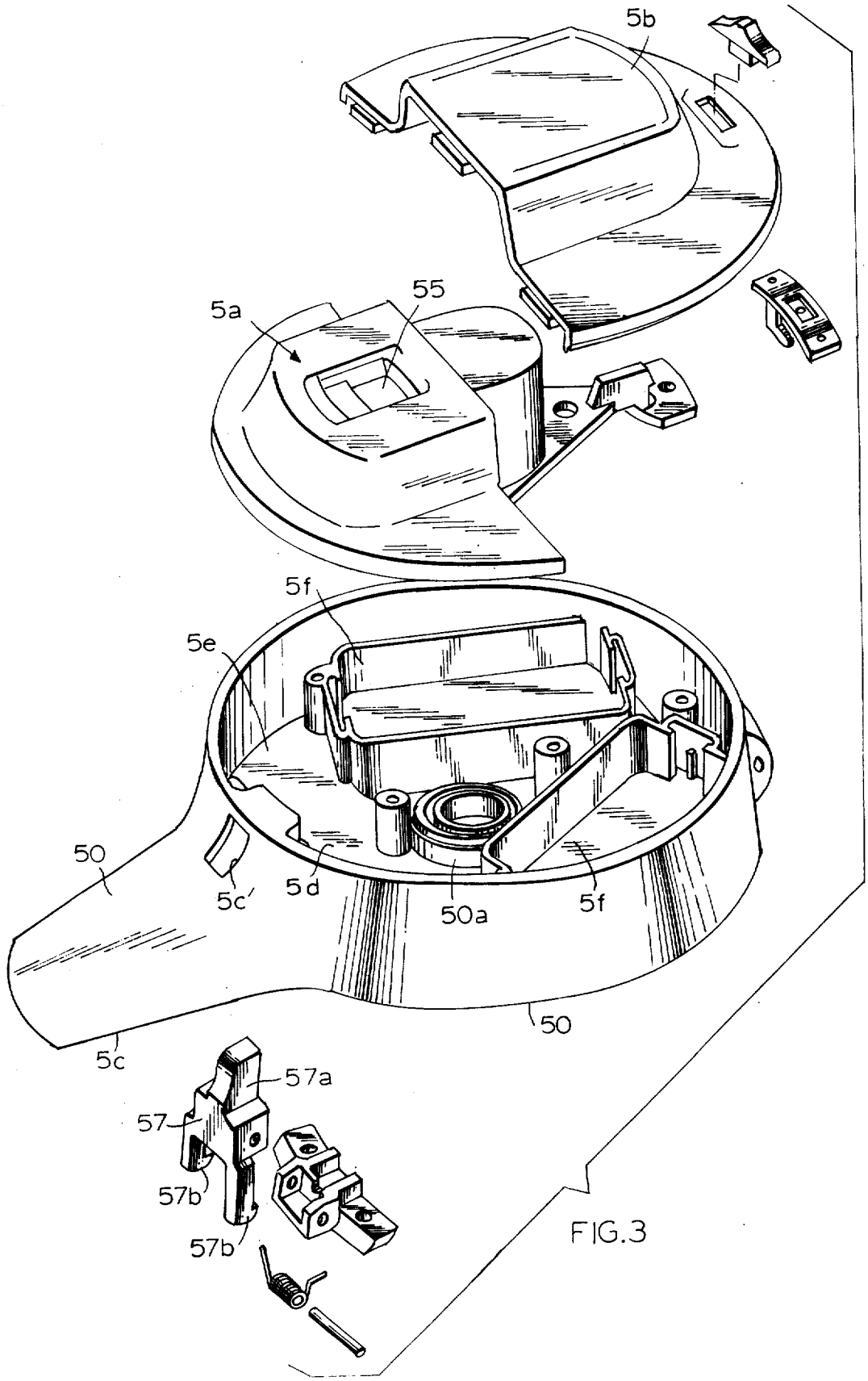
FIG. 3 is a perspective view of the boxed cover disassembled.

The projecting portion of the motor shaft 52 is perfectly sealed with a seal plate 53, engaging closely with the motor shaft 52, which is pressed against to the upper surface of the circular pedestal 50a by a spring 54. A push button is equipped on the fixed cover 5a and the power supply is controlled by the opening and closing of a movable contact 56a and a fixed contact 56b switched by the push button 55. Since the dry cell chambers 5f, 5f, in the right and left sides of the space 5d are not covered by the fixed cover 5 but a removable cover 5b, it is easy to exchange the dry cells. In the space 5c, as shown FIG. 3, a lock lever 57 equipped with a nail 57b which engages with a hook 4a on the upper portion of the vessel 4. The operation portion 57a of the lock lever 57 projects upward through a hole 5c' which is perforated far from the isolated chamber 5e. In this embodiment, a support bottom plate 5g is positioned beneath the space 5c and the nail 57b of the lock lever 57 projects downward from a hole 5g' perforated in the support bottom plate 5g.

Figure 5:
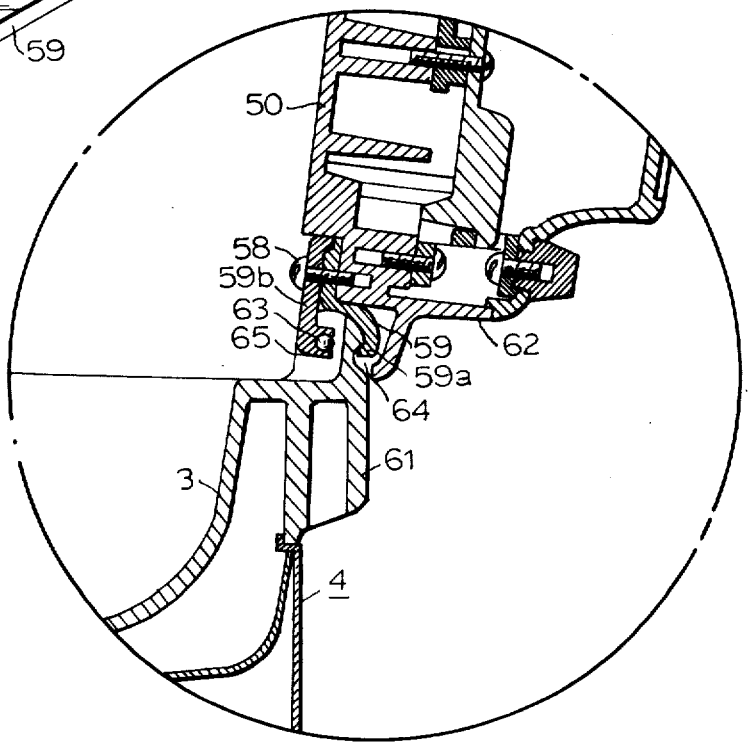
FIG. 5 is a sectional view of the hinged part of the boxed cover showing the locked state.

A locking member 59, made of an elastic body such as spring material, is attached by a screw 58 at the hinged part 6 of the boxed cover 5, such as the rear part of the bottom member 50. The nail 59a is designed so that the end of the locking member 59 can press the lower hinge piece 61 or the upper hinge piece 62 by an elastic force, when the boxed cover 5 is opened a necessary angle (normally 90 degrees or so) to fill the bottle 1 with liquid. On the other hand, since a groove 64, whereinto the nail 59a is inserted, is prepared at a position of the lower hinge piece 61 or the upper hinge piece 62 where the nail 59a touches, the boxed cover 5 is, as shown in FIG. 5, locked in an opening position when the nail 59a is inserted into the groove 64 by an opening operation of the boxed cover 5. The hooking force between the groove 64 and the locking member 59 is designed so that the boxed cover 5 does not close by its own weight when the vessel 4 is tilted and the boxed cover 5 is open by more than 90 degrees from the vessel 4 and so that the boxed cover can be pushed down by a rather weak force when it should be closed.

Figure 4A:
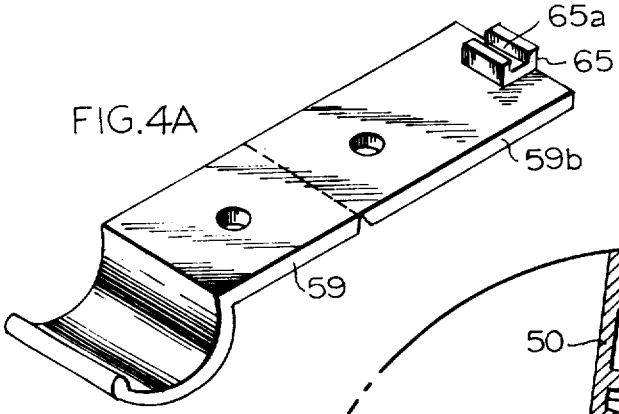
FIGS. 4 (A) and (B) are perspective views showing the relation between a hinge rod and a locking piece which locks the opened boxed cover.
Figure 4B:
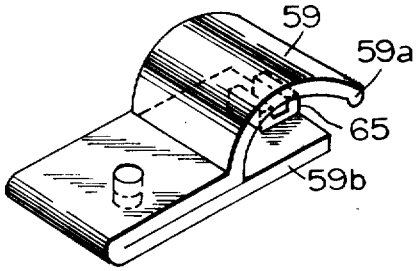

In this embodiment, the locking member 59 is folded on a support plate 59b which is formed with the locking member 59 as shown in FIGS. 4 (A), (B), and a hinge rod holder 65 with a narrow groove 65a is attached to the support plate 59b. Furthermore, a guide surface 61a, whose sectional view is arc-like, is provided above the lower hinge piece 61, the hinge rod 63 being the center of the guide surface 61a, as shown in FIG. 2.

When the boxed cover 5 is opened, the nail 59a of the locking member 59 slides on the guide surface 61a, and then, at the instant the nail 59a reaches to the groove 64 on the outside of the guide surface 61a, the nail 59a, as shown in FIG. 5, enters drastically into the groove 64 by the elastic force of the locking member 59.

In this bottle of the invention, a suitable guide 11 is provided at the upper part of the fistulous plug 7 and at the bottom member 50 so that the boxed cover 5 always closes with an accurate position relative to the vessel 4, when the boxed cover 5 is closed after being released from its locked, open state. In the embodiment shown in FIG. 7, an upper piece 11a of the guide 11 is formed as an concentric cylinder with the motor shaft 52 at the opposite side of the circular pedestal 50a of the center of bottom member 50 or around the projection of the motor shaft 52. The upper piece 11a has a conical inside surface and is expanded downward. A lower piece 11b corresponding to the upper piece 11a is formed as a concentric cylinder with the propeller shaft 81 on the common upper cover 7c of the fistulous plug 7 or around the projection of the propeller shaft 81, and the lower piece 11b has a conical surface which is contracted upward. In this embodiment, since the outside diameter at the upper end of the lower piece 11b is smaller than the inside diameter at the lower end of the upper piece 11a, the upper end of the lower piece 11b is always positioned in the lower opening of the upper piece 11a, even if the boxed cover 5 does not hinge securely, when the boxed cover 5 is closed. Therefore, the boxed cover 5 itself returns to the closed position shown in the FIGURES or the position wherein the inside surface of the upper piece 11a perfectly engages with the outside surface of the lower piece 11b by the mutual guiding operation of both surface, when the boxed cover is pushed forward further. When the boxed cover 5 is closed, both axial lines of the motor shafts 52 and the propeller shaft 81 always concur with each other, and the upper clutch piece 10a smoothly and perfectly engages the lower clutch piece 10b.

Subsequently the operation of the bottle of this invention is explained hereafter. In order to fill the vacuum bottle 1 with liquid W, liquid W is poured through the funnel-like pour member 3 after the nail 57b is released from the hook 4a on the vessel 4 by a touch on the operation portion 57a of the lock lever 57, the boxed cover is opened by more than 90°, and the fistulous plug 7 is removed. While the boxed cover 5 is open more than 90°, it is locked in position as described above, by the engagement of the nail 59*a* of the locking member 59 with the groove on the lower hinge piece 61 or the upper hinge piece 62. Therefore, unexpected accidents caused by a sudden closing, such as an injury to user's fingers or a damage of the vacuum bottle 1, can be prevented.

After the liquid W is completely poured, the fistulous plug 7 is reinserted into the mouth 1' of the vacuum bottle through the bottom opening 3' of the pour member 3, and the boxed cover is closed. During above operation, the boxed cover 5 can be guided exactly to the correct closing position by the function of the guide 11 comprising the combination of the upper piece 11*a* and the lower piece 11*b*, and the upper clutch piece 10*a* smoothly and perfectly engages with the lower clutch piece 10*b* by during this motion. The motor 51 rotates and drives the propeller 82 through the upper clutch piece 10*a* and the lower clutch piece 10*b* after the push button 55 is pushed to close the contacts 56*a* and 56*b* under this condition. The liquid W pours out of the bottle by way of the lower opening 8*d*, the inner pipe 8, the inside cylinder 7*a* of the fistulous plug 7, the pouring pipe 9*a* and the round pipe 9*b*. Since the liquid W in the valve chamber 93 passes through the hole 94' of the valve holder 94, the existence of the valve holder 94 does not prevent the liquid W from pouring. Because of the smooth and perfect engagement of the clutch pieces, as described before, troubles, such as strong vibration, loud noises and unsteady pouring due to an eccentric rotation of the propeller shaft 81, never occur. While the propeller, shaft 81 rotates, the liquid W tends to leak out of the fistulous plug 7 through the shaft holes of the partitions 72, 73, which bear the propeller shaft 81, and the shaft hole of the common upper cover 7*c*. But the leak through the shaft hole of the common cover 7*c* is prefectly prevented, since a water seal packing 75 is attached around the propeller shaft 81. Furthermore, because the isolated chamber 5*e* containing electrical parts such as the motor 51 and the contacts 56*a*, 56*b* is perfectly isolated from the space 5*c* by the bottom member 50 itself vapors of the liquid to be poured not leak into the isolated chamber 5*e*, even if the vapor leaks into the space 5*c* from the hole 3*a'* of the beak portion 3*a* at the upper part of the pouring mouth of the round pipe 9*b* through the hole 5*g'* of the support bottom plate 5*g*. Adding to above description, the opening of the circular pedestal 50*a*, which is the one and only downward opening of the isolated chamber 5*e*, is tightly sealed by a sealing plate 53, so that the electrical parts such as the motor 51 are prevented from the damage to be caused by water or vapor.

If the bottle of this invention is dropped by accident, the level of the pouring mouth of the round pipe 9*b* becomes lower than its jointing end. But at this moment, the valve holder 94 leans forwardly and the ball valve 95 in the valve holder 94 is driven by the gravity and shuts the surface of the valve stopper of the pressing cylinder 96. Therefore, the liquid W can not flow out to the round pipe 9*b* and the liquid is prevented from flowing when the bottle is dropped. Since the fistulous plug 7 is constructed separately from the boxed cover 5 and the vessel 4 and the motor rotation is transmitted to the propeller shaft by the engagement of the upper clutch piece 10*a* provided at the boxed cover 5 and the lower clutch piece 10*b* provided at the fistulous plug 7, the bottle of this invention has the following advantages when compared with a former plug unit which is assembled together with a box containing electrical parts such as a motor.

1. Even if the materials of the plug deteriorate due to continued exposure the liquid or vapor, the cost of exchanging parts is low because it is not necessary to exchange the boxed cover 5 itself.

2. The initial cost of the material is low because it is not necessary to use expensive metalic materials in order to prevent the plug from deteriorating.

3. Since all the rather heavy parts such as the motor and dry cells are contained in the boxed cover and are constructed separately from the plug, the force to remove the plug is small.

4. There is little possibility of damaging the inside surface of the vacuum bottle with the lower part of the inner pipe, since the diameter of the portion which is pulled up for removing can be designed rather small which makes it easy for the plug to be pulled uprightly.

The bottle with an electrically-operated pump of this invention, as minutely described above, is designed quite reasonably and is free from the unconveniences in handling, expensive cost and difficult maintenance and repair which have existed in some of the prior art bottles, so this invention greatly contributes to a development of the industrial technology about this kind of bottle.

I claim as my invention:

1. A container with an electrically operated pump comprising:

a casing open at the top thereof;

a vacuum bottle within said casing, said vacuum bottle having an open mouth at the top thereof;

a funnel-like pour member fitted over the top portion of said casing, the bottom of said member having an opening therein at least as large as the outside diameter of the mouth of said vacuum bottle and fitted around the mouth of said vacuum bottle in the open top end of said casing;

a hollow fistulous plug fitted within the opening in said pour member and extending downward therefrom into the mouth of said vacuum bottle;

a first pipe connected to the bottom of said fistulous plug and extending downward therefrom into said vacuum bottle;

a propeller shaft fitted through the top of said fistulous plug and extending downward into said first pipe;

a first clutch member at the top of said propeller shaft above said fistulous plug;

a propeller blade at the bottom of said shaft;

a second pipe connected to the upper portion of said fistulous plug above the mouth of said vacuum bottle and extending substantially laterally therefrom;

box member means fitted over said pour member for covering the top of said pour member; and electric motor means within said box member means and engagable with said first clutch member on said propeller shaft for rotating said shaft, said motor means comprised of:

a battery operated electric motor having a rotary shaft extending therefrom, a second clutch member attached to the end of said rotary shaft and engagable with said first clutch member when said box member is positioned over said pour member;

at least one dry cell battery for operating said motor, and switch means for operating said electric motor.

2. A container and pump as claimed in claim 1 wherein said box member means is hingedly connected to the top of said pour member.

3. A container and pump as claimed in claim 1 further comprising guide means between the top of said fistulous plug and the bottom of said box member means for guiding said shaft of said electric motor with said second clutch member thereon toward said first clutch member on said propeller shaft extending through said fistulous plug, and for aligning the axis of rotation of said motor shaft with the axis of rotation of said propeller shaft.

4. A container and pump as claimed in claim 1 further comprising:

hinge means hingedly connecting said box member means to said pour member, said hinge means comprised of:

an upper hinge member integrally formed with said box member means, a lower hinge member integrally formed with said pour member, a pin member connecting said hinge members for rotation thereabout, and one of said hinge members having a groove therein; and locking means attached to said hinge member opposite said hinge member having said groove therein for engaging said groove when said box member means is rotated from said pour member about said hinge means, whereby said box member means is locked in the open position away from said pour member.

5. A container and pump as claimed in claim 4 wherein:

said groove is contained in said lower hinge member; and said locking means is comprised of a lock member of resilient material attached to said upper hinge member and engageable with said groove in said lower hinge member when said box member means is opened about said hinge means.

6. A container and pump as claimed in claim 1, wherein said box member means has a plurality of compartments therein, one of said compartments located at the forward portion thereof being open beneath said box means toward said pour member and one of said compartments located at the rearward portion of said box means, separated completely from said first-mentioned forward compartment, being open at the top thereof, wherein said motor means is contained within said rear compartment open at the top, and further comprising locking means in said forward compartment extending downward therefrom and engageable with said pour member therebeneath for locking said box member means in the closed position over said pour member, said locking means further extending upward from said forward compartment through the top thereof.

7. A container and pump as claimed in claim 1 further comprising valving means in said second pipe for preventing fluid from flowing through said second pipe when said second pipe is inclined forwardly.

8. A container and pump as claimed in claim 1, wherein said fistulous plug has a stepped, shoulder portion at the lower inside surface thereof;

wherein said first pipe connected to said fistulous plug is inserted in the lower end of said plug and has a flange around the upper edge thereof engaging said stepped portion of said plug, said first pipe further having an inward groove around the circumference thereof at the location where said first pipe extends from said plug, and further comprising a resilient member fitted into said groove.

9. A container and pump as claimed in claim 1 wherein said fistulous plug is comprised of:

an inside cylinder and an outside cylinder, one within the other and spaced from each other, surrounding said propeller shaft, said inside cylinder being connected at the lower end thereof to said first pipe and at the upper side portion thereof to said second pipe fitted through said outer cylinder;

a common cover covering the top of both of said cylinders and surrounding said propeller shaft through said cylinders beneath said first clutch member at the top of said propeller shaft;

a plurality of lateral partitions spaced vertically from each other within said inner cylinder beneath said cover and above said second pipe fitted thereinto and surrounding said propeller shaft, said partitions forming at least one compartment therebetween within said inner cylinder; and said inner cylinder has at least one opening through the side wall thereof between at least two of said partitions forming a compartment, said opening being open into the space between said inner and outer cylinders.

* * * * *